US007820076B2

(12) United States Patent
Arafat et al.

(10) Patent No.: US 7,820,076 B2
(45) Date of Patent: Oct. 26, 2010

(54) OLEAGINOUS CORROSION AND MILDEW-INHIBITING COMPOSITION

(75) Inventors: El Sayed S. Arafat, Leonardtown, MD (US); Craig A. Matzdorf, California, MD (US); James A. Whitfield, Newport, NC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 969 days.

(21) Appl. No.: 11/325,283

(22) Filed: Dec. 20, 2005

(65) Prior Publication Data

US 2007/0096060 A1 May 3, 2007

Related U.S. Application Data

(63) Continuation-in-part of application No. 11/264,336, filed on Oct. 27, 2005.

(51) Int. Cl.

| | |
|---|---|
| ***C23F 11/00*** | (2006.01) |
| ***C23F 11/12*** | (2006.01) |
| ***C23F 11/16*** | (2006.01) |
| ***C23F 11/167*** | (2006.01) |
| ***C07C 309/62*** | (2006.01) |
| ***B05D 1/00*** | (2006.01) |
| ***B05D 1/18*** | (2006.01) |

(52) U.S. Cl. ..... 252/395; 252/389.2; 252/389.21; 252/389.22; 252/389.52; 252/389.61; 252/391; 252/406; 252/409; 106/14.13; 106/14.16; 106/14.12; 508/390; 508/408; 508/388; 508/184; 508/389; 208/18; 208/19; 427/207.1; 427/287

(58) Field of Classification Search ..... 252/389.21, 252/391, 395; 508/388, 389; 106/14.13, 106/14.12; 427/435

See application file for complete search history.

(56) References Cited

U.S. PATENT DOCUMENTS

| | | | | | |
|---|---|---|---|---|---|
| 2,378,820 | A | * | 6/1945 | Amott | 508/313 |
| 2,404,871 | A | * | 7/1946 | Van Ess et al. | 508/567 |
| 3,350,308 | A | * | 10/1967 | McMillen | 508/392 |
| 3,480,550 | A | * | 11/1969 | Henderson et al. | 508/391 |
| 3,624,208 | A | * | 11/1971 | Schmolka | 514/785 |
| 4,218,329 | A | * | 8/1980 | Koh | 508/170 |
| 5,169,564 | A | * | 12/1992 | Gallacher et al. | 252/400.52 |
| 5,326,566 | A | * | 7/1994 | Parab | 424/401 |
| 5,549,787 | A | * | 8/1996 | Sain et al. | 162/5 |
| 5,726,134 | A | * | 3/1998 | Adams | 508/391 |
| 5,902,572 | A | * | 5/1999 | Luebbe et al. | 424/66 |

(Continued)

*Primary Examiner*—Joseph D Anthony
(74) *Attorney, Agent, or Firm*—Mark D. Kelly; Mark O. Gluy

(57) ABSTRACT

The invention relates to an oleaginous mildew and corrosion-inhibiting composition, and the use of said composition to protect metal from corrosion and mildew. The composition comprises, in parts by weight, from about 20 to 60 parts of an oleaginous material such as a lubricating oil, 10 to 40 parts of organic solvent, 20 to 60 parts of corrosion-inhibitor consisting of a sulfonic acid-carboxylic acid metal complex or a mixture of said metal complex with a small but effective amount of an oil soluble alkyl phosphate, from 0.1 to 2.0 parts of an oil soluble antioxidant, from 0.0 to 5.0 parts of a water-displacing compound, an effective amount of a mildew-inhibiting compound, and from 0.0 to 1.0 part of a heterocyclic metal deactivator.

27 Claims, 5 Drawing Sheets

U.S. PATENT DOCUMENTS 6,432,432 B1 * 8/2002 Mohseni et al. ..... 424/405
6,551,967 B2 * 4/2003 King et al. ..... 508/391
6,596,672 B1 * 7/2003 Carrick et al. ..... 508/192
6,617,287 B2 * 9/2003 Gahagan et al. ..... 508/192
7,407,917 B2 * 8/2008 Shiga et al. ..... 508/194
2003/0000866 A1 * 1/2003 Cain ..... 208/18
2003/0134756 A1 * 7/2003 Carrick et al. ..... 508/398
2006/0257441 A1 * 11/2006 Komai et al. ..... 424/405

* cited by examiner

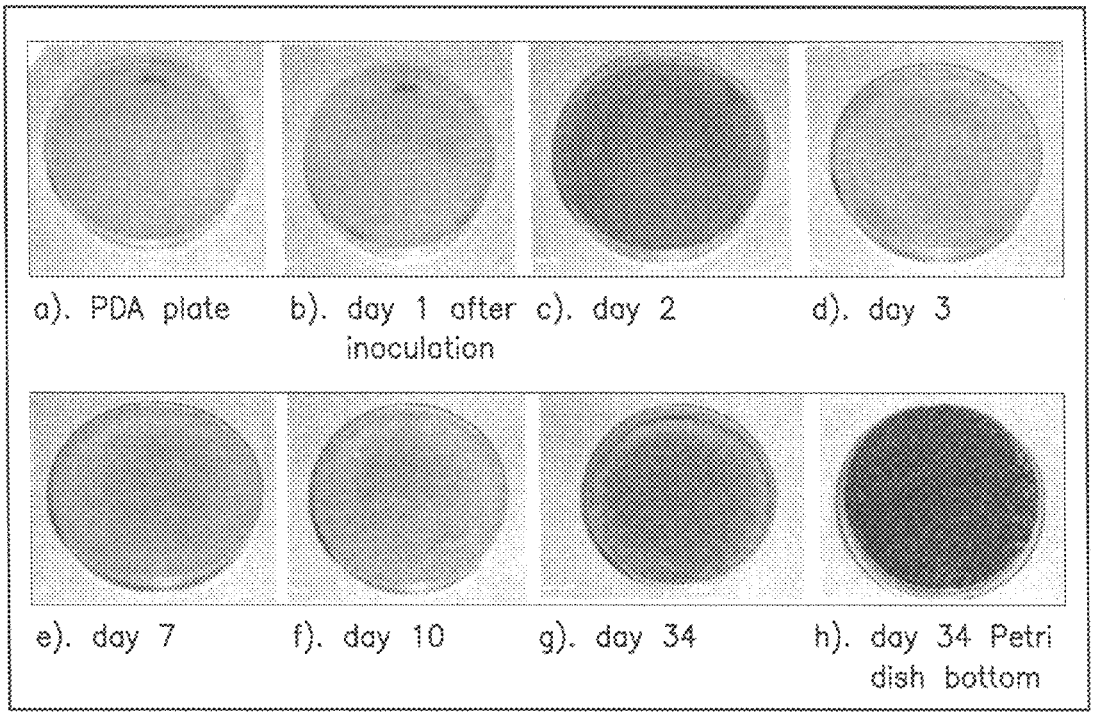
FIG-1 (a-h)
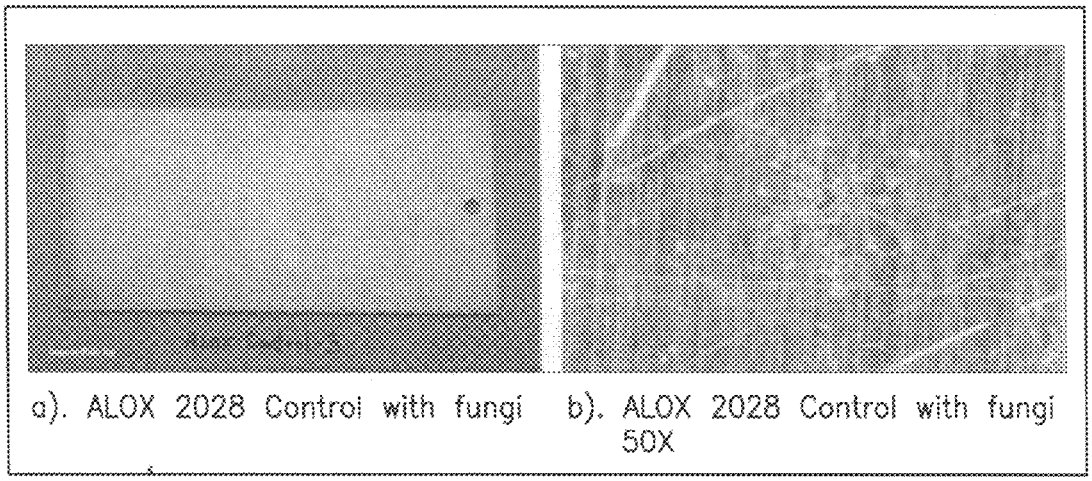
FIG-2 (a-b)

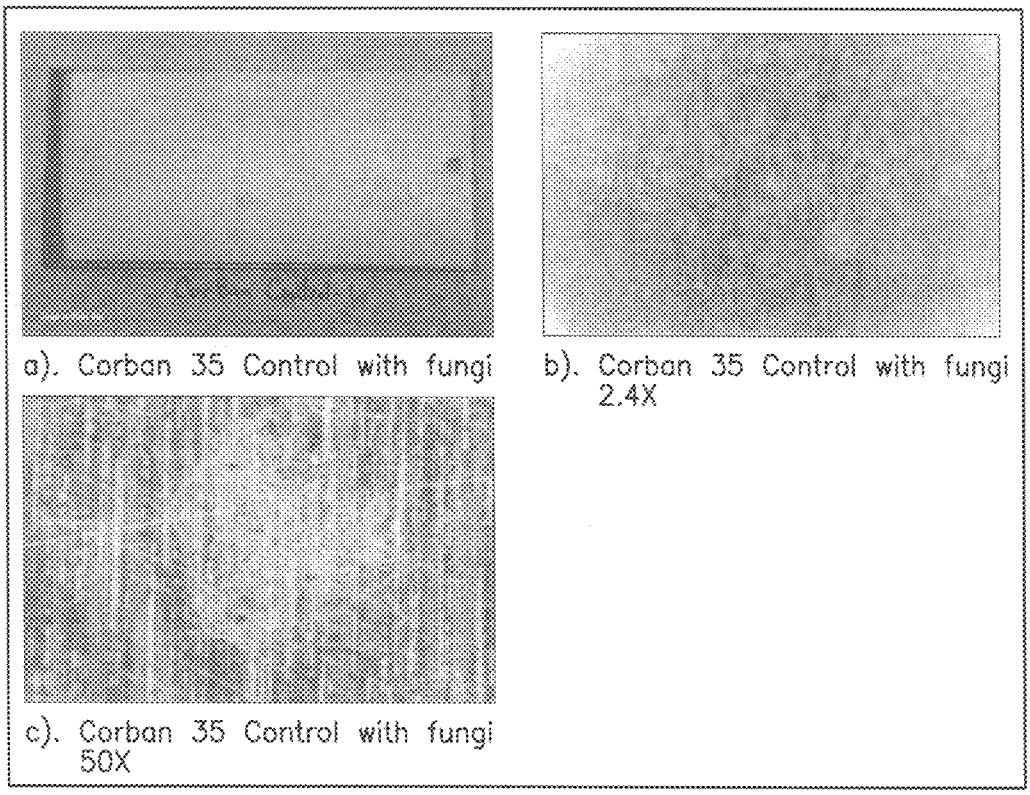
FIG-3 (a-c)

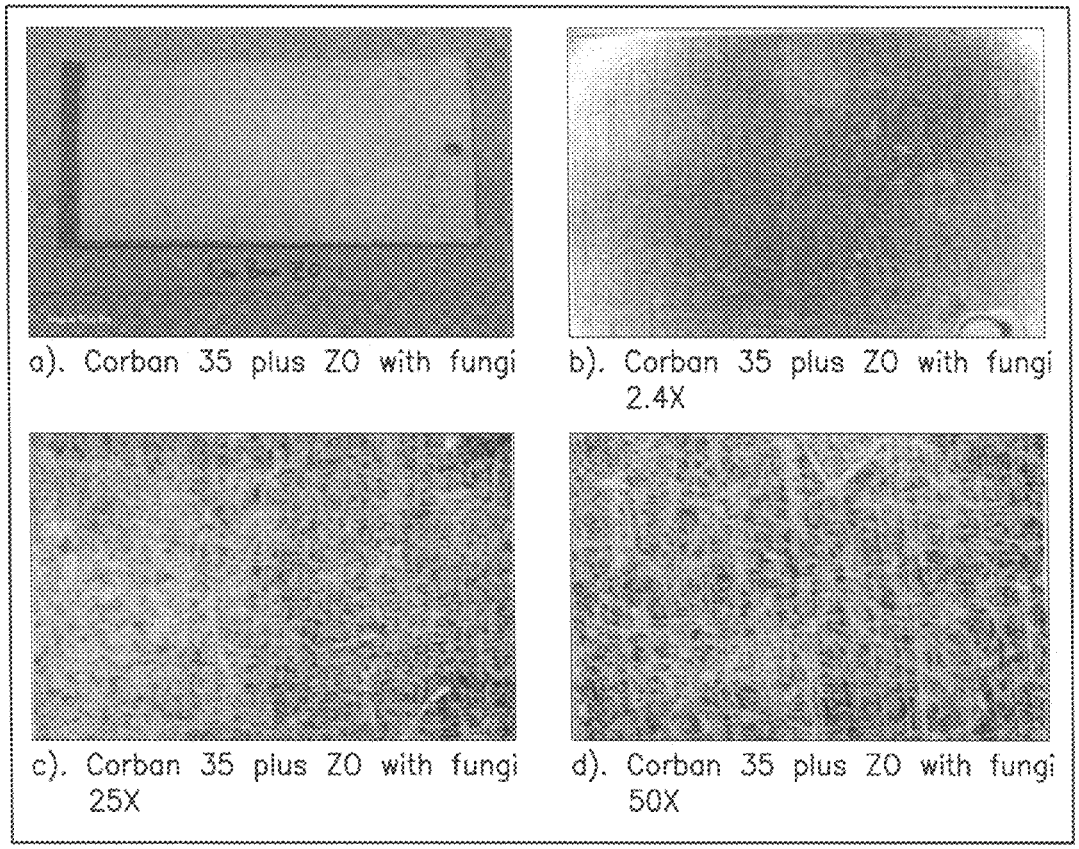
FIG-4 (a-d)

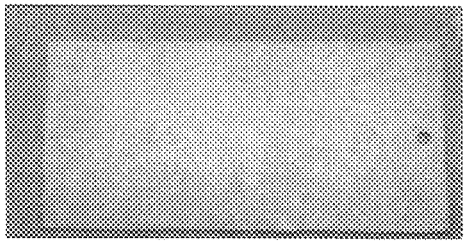
a). Al panel/hydraulic fluid only/fungi
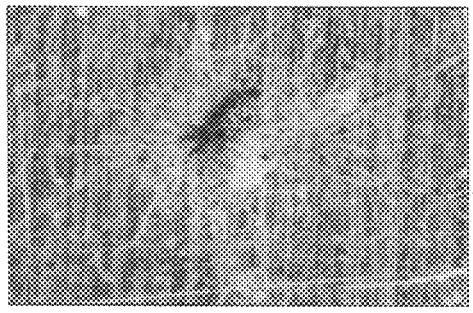
b). Al panel/hydraulic fluid only/fungi 50X
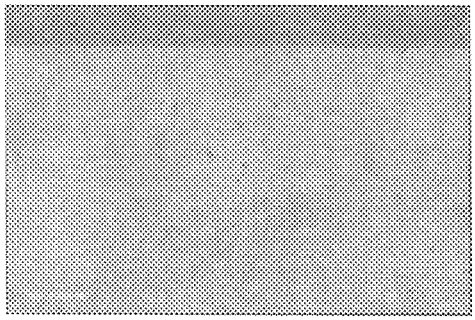
c). Al panel/hydraulic fluid only/fungi
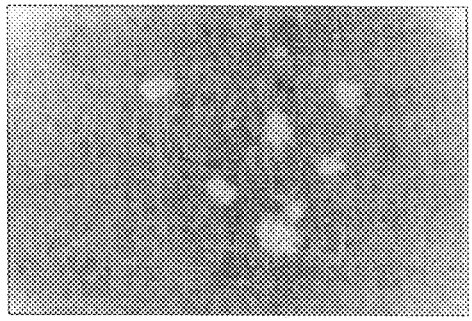
d). Al panel/hydraulic fluid only/fungi 2.4X
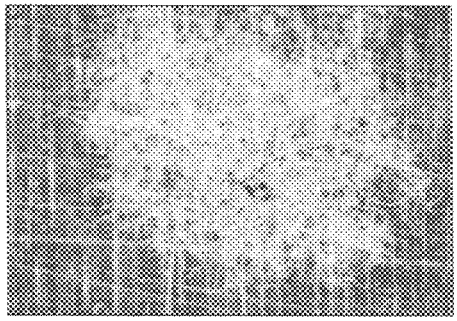
e). Al panel/hydraulic fluid only/fungi 25X
FIG-5 (a-e)

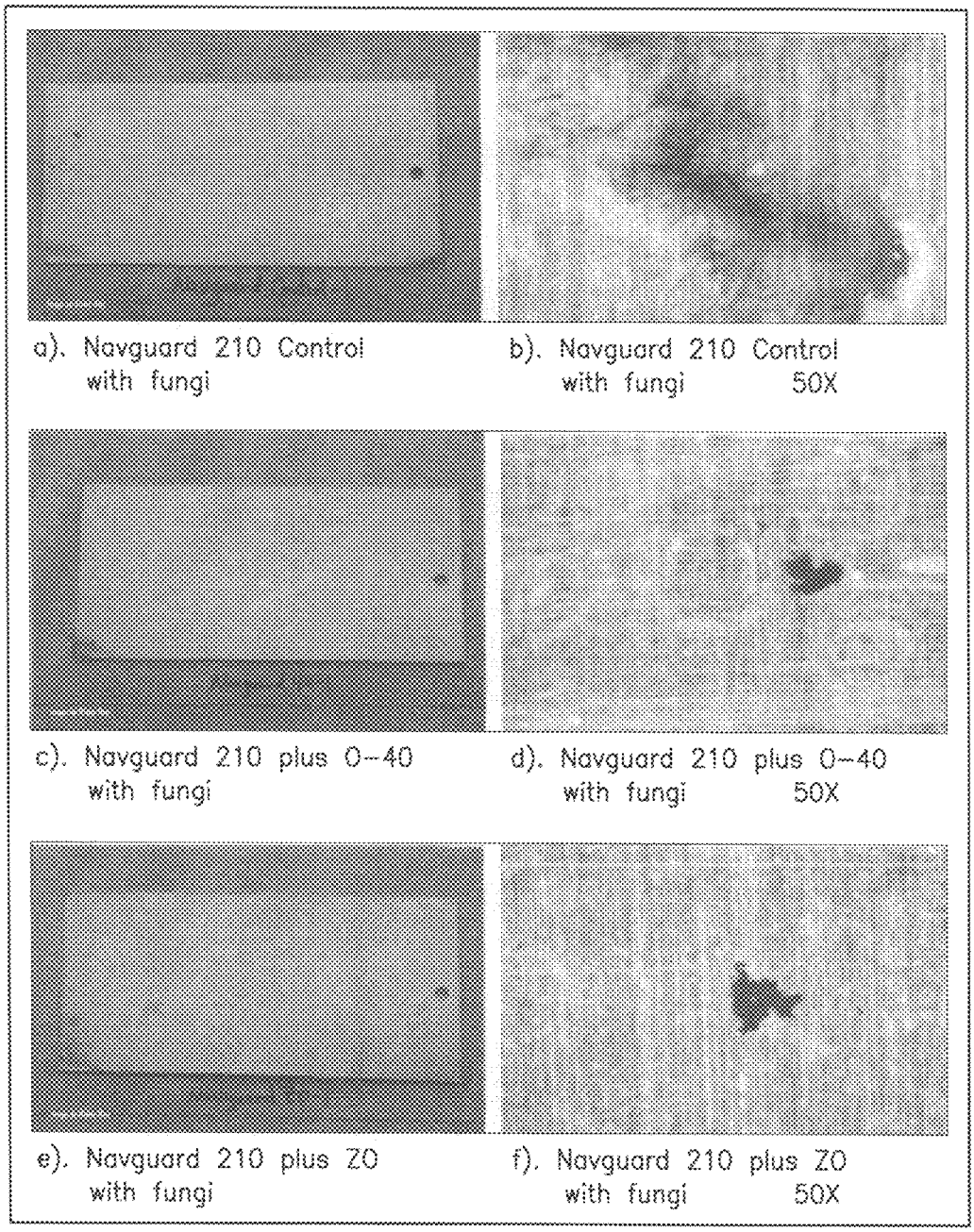
FIG-6 (a-f)

OLEAGINOUS CORROSION AND MILDEW-INHIBITING COMPOSITION

RELATED U.S. APPLICATION DATA

This application is a continuation-in-part of co-pending application Ser. No. 11/264,336 filed on Oct. 27, 2005.

ORIGIN OF INVENTION

The invention described herein was made by employee(s) of the United States Government and may be manufactured and used by or for the Government for governmental purposes without the payment of any royalties thereon or therefor.

BACKGROUND OF THE INVENTION

1. Field of the Invention

This invention relates to oleaginous compositions and to the method of using said compositions to inhibit mildew and prevent the corrosion of metal. More specifically, this invention relates to oleaginous compositions comprising lubricating oils, organic solvents, corrosion inhibitors, rust-preventive agents, antioxidants, metal deactivators, mildew-inhibiting compounds and water-displacing agents. The oleaginous mildew and corrosion-inhibiting compositions of this invention are useful as coatings on various metal substrates including ferrous metals, aluminum, magnesium, and various other aluminums and ferrous alloys and particularly as mildew-inhibiting and corrosion-resistant coatings for aircraft and automotive frames. For example, as aircraft age, corrosion and mildew occurs in the internal structures which are not easily inspected or treated. Especially in harsh environments where humidity, salt and heat conspire to reduce metal parts to piles of oxide, fogging CPC's (Corrosion Preventive Compounds) that contain mildew-inhibiting agents into the internal spaces of airframes has been found to be effective in combating mildew and metal degradation. An objective of this invention was to develop an effective corrosion preventive compound (CPC) with mildew inhibition capabilities to prevent corrosion and simultaneously inhibit mildew growth on interior aircraft surfaces. The compositions of this invention reduce the cost of aircraft maintenance, extend aircraft's life cycle, reduce aircraft's down time and provide a healthy environment for the aircraft's crew. In comparison, current CPC's must be annually reapplied several times using time-consuming procedures. As an alternative to the current CPC's, this invention provides high performance, long lasting Corrosion Preventive Compounds (CPC's) for internal airframe applications to minimize the costs attributed to aging aircraft.

2. Background

Generally, CPC's comprise a barrier film containing corrosion inhibitors, various other additives and sometimes carrier solvents. Currently, film-formers for CPC's include natural and synthetic oils, oxidized petroleum fractions and polymers, depending on the desired application and performance requirements. Mineral oil as well as wool wax have proved useful, but more recent developments involve the use of polymeric resins, including the acrylics, silicones, urethanes and other proprietary materials. Most of these film formers provide a physical barrier to the corrosive environment, but cannot prevent the slow diffusion of corrosive agents through the film. Some films, particularly films containing the naturally derived materials, are not resistant to oxidation and require antioxidant additives to protect the film from degradation. In fact, without these and other additives, the barrier films often provide poor corrosion-resistance. The blending of additives in the film is usually the answer to superior performance with minor differences in structure often producing major effects in staving-off the corrosive attack of the environment.

In addition, corrosion preventive additives include not only anodic and cathodic inhibitors, but also acid acceptors and chelating agents. These materials provide a synergism with the film former that often produces outstanding corrosion protection. For example, calcium and barium salts of sulfonic acids (such as the alkylbenzenesulfonates and dinonylnaphthalene sulfonates) are outstanding metal deactivators resulting from the strong adsorption of the sulfonate group. The non-polar portion of the molecule tends to shield the metal surface from ionic attack of various environmental species. Phosphate compounds have been used, most recently, as a difunctional additive where the distance between the phosphate moieties was optimized for a particular resin system. In addition, vapor phase corrosion inhibitors (such as the dicyclohexylammonium compounds, various amines, and benzoates) can be useful in CPC films especially for internal applications where near-stagnant atmospheres exist.

Many of these CPC's contain carrier solvents which require evaporation to deposit the protective film. However, the use of solvents is regulated in many locations either by content (e.g. grams per liter volatile organic compounds (VOC)) or by vapor pressure. In addition to the solvent limitations, some additives previously used for their exceptional performance (such as barium sulfonates) are cited because of their heavy metal content. Substitute vehicles (such as waterborne resins) and substitute additives (such as calcium sulfonates) are possible, but only when the critical properties of the CPC performance are well understood.

Moreover, the formulation of CPC's has limitations. Higher concentrations of many additives results in higher viscosities causing the products to suffer performance problems. Ineffective water-displacement, incomplete crevice penetration, and poor sprayability are some of the problems that sooner or later contribute to the CPC's failure. Another approach to applying more corrosion-preventing additives is to use products that dry to thicker films, however, thicker CPC's attract hygroscopic dust and dirt that adds considerable weight to small aircraft which leads to maintenance problems such as the inability to inspect a surface. Further, there are several failure mechanisms for CPC's. Hard films fail when thermal expansion, mechanical movement or fatigue causes cracking of the metal substrate. Soft films fail when water slowly permeates and dissolves or emulsifies the CPC. Slow diffusion of environmental corrodents through a film will sooner or later initiate corrosion, damaging the film and allowing more direct attack on the surrounding metal. Some films flow sufficiently to heal themselves in spite of repeated physical film damage, however, this also means that flow occurs when there is no damage, resulting in decreasing film thickness and subsequent loss of the corrosion preventive properties. Further, some additives to the CPC's catalyze the hydrolysis of film formers which leads to porosity or even complete destruction of the film. Even atmospheric oxidation of the film or UV radiation induced failure can occur prior to the expected life of the film.

In addition to corrosion, there is the serious problem of mildew. Mold and mildew are simple microscopic organisms that grow anywhere if they have adequate moisture, nutrients and appropriate temperature. Many spores of mold and mildew are present at all times in indoor and outdoor air. These spores can settle, germinate, and grow wherever good growth conditions are found. It is reported that fungi appear to be able to use certain operational fluids, such as hydraulic fluid (MIL-PRF-83282) and corrosion preventive compounds (CPCs) as nutrients; see B. Little, R. Ray and J. Lee, "An Overview of Microbiologically Influenced Corrosion in Aircraft", Naval Research Laboratory, Stennis Space Center, Technical Report No. A709314; (1997). Mildew growth is a serious problem particularly in hot, wet, and humid environments. It causes chronic health problems for the aircraft crew, requires excessive maintenance efforts, damages protective paint coatings, and damages bare metal surfaces. One study of fungal contamination on the interior surface of H-46 and H-53 rotary-wing aircraft at the Naval Air Depot, Cherry Point, N.C., isolated eight genera of micro fungi; see Lavoie, M. D., Little, B. J., "Fungal Contamination of H-53 Aircraft", Naval Research Laboratory, Stennis Space Center, Technical Report NRL/MR/7333-96-7725, (1996). The study also indicated that some corrosion on unprotected aluminum surfaces could be attributed to bacterial and fungal growth. One of the isolated fungi (*Aureobasidium*) from the H-53 is known to cause superficial discoloration on latex paint; see R. A. Zabel, and F. Terracina, "The Role of *Aureobasidium Pullulans* in the disfigurement of latex paints", Development in Industrial Microbiology, Vol 21, Pages 179-190, (1980).

Corrosion preventive compounds (CPCs) are used in various applications for corrosion control and prevention. A modified corrosion-preventive composition with mildew inhibitor capabilities has been developed to prevent corrosion and inhibit mildew growth on the interior of metal surfaces. Combining mildew inhibitors and corrosion-preventive compounds in one composition advances the efforts for controlling two major problems particularly in aircraft maintenance (mildew growth and corrosion).

SUMMARY OF THE INVENTION

This invention relates to oleaginous corrosion-resistant and mildew-inhibiting compositions and to the method of using said compositions to prevent mildew and inhibit corrosion of various metal surfaces. The compositions comprise from about 20 to 60 parts by weight of at least one oleaginous material e.g. lubricating oil, 10 to 40 parts by weight of at least one organic solvent, 20 to 60 parts by weight of corrosion inhibitors, 0.1 to 2.0 parts by weight of antioxidants, 0.0 to 5.0 parts by weight of water-displacing compounds, 0.1 to 3.0 parts by weight of a mildew-inhibiting compound, and from 0.0 to 1.0 part by weight of metal deactivators.

Therefore, it is an object of this invention to provide an oleaginous mildew-inhibiting and corrosion-resistant composition and a method of using said composition to inhibit mildew and prevent the corrosion of metal.

It is another object of this invention to provide an oleaginous mildew and corrosion-resistant composition in the form of a liquid or semi-solid.

It is still another object of this invention to provide an oleaginous mildew and corrosion-inhibiting composition and a method of using the composition to form a protective coating on aluminum and ferrous metal substrates.

It is still a further object of this invention to provide a combination of mildew inhibitors blended with a corrosion-preventive compound (CPC) to eliminate mildew growth and corrosion on the interior of aircraft surfaces.

These and other object of this invention will become apparent by reference to the detailed description when considered with the accompanying figures.

DESCRIPTION OF THE DRAWINGS

FIG. 1 (panels a-h) shows inoculated PDA plates exhibiting growth within one day with mycelium over the surface.

FIG. 2 (panels a-b) shows fungal growth on aluminum panels coated with Alox 2028 as a control (Commercial CPC product) after 35 days.

FIG. 3 (panels a-c) shows fungal growth on aluminum panels coated with Corban 35 as a control (Commercial CPC product) after 35 days.

FIG. 4 (panels a-d) shows fungal growth on aluminum panels coated with Corban 35 spiked with Zinc Omadine after 35 days.

FIG. 5 (panels a-e) shows fungal growth on aluminum panels coated only with hydraulic fluid after 35 days.

FIG. 6 (panels a-b) shows fungal growth on aluminum panels coated with Navguard 210 as control after 68 days.

FIG. 6 (panels c-d) shows fungal growth on aluminum panels coated with Navguard 210 spiked with Omacide 0-40 after 68 days.

FIG. 6 (panels e-f) shows fungal growth on aluminum panels coated with Navguard 210 spiked with Zinc Omadine after 68 days.

DETAILED DESCRIPTION OF THE INVENTION

This invention relates to an oleaginous mildew and corrosion-resistant composition and to the method of inhibiting mildew and corrosion of various metal surfaces including metals such as aluminum, aluminum alloys, and various ferrous metals such as steel. The oleaginous compositions of this invention comprise, in parts by weight, from about 20 to 60 parts and preferably 35 to 45 parts of at least one lubricating oil including mineral oils, synthetic oils and mixtures thereof in any ratio, from about 10 to 40 parts and preferably about 15 to 30 parts of at least one organic solvent such as petroleum distillates and various mixtures of these solvents in any ratio, from about 20 to 60 parts and preferably from 35 to 45 parts of an oil soluble corrosion inhibitor selected from the group consisting of sulfonic acid-carboxylic acid metal complexes and mixtures of said sulfonic acid-carboxylic acid metal complexes with an oil soluble organic alkyl phosphate wherein said sulfonic acid-carboxylic acid metal complex ranges from about 97 to 99.9% by weight of the mixture, and the organic alkyl phosphates range from about 0.1% to 3.0%, or 0.5% to 1.0% by weight of the mixture, from about 0.1 to 2.0 parts and preferably 0.5 to 1.0 parts of an oil soluble organic antioxidant, from about 0.0 to 5.0 parts and preferably 1.0 to 2.0 parts of a water-displacing agent or compounds such as the alkylene glycols, aliphatic alcohols, glycol ethers, ethers, ether alcohols, glycols, alkoxy alcohols and preferably the lower molecular weight alkylene glycols, from 0.0 to 1.0 part and preferably from about 0.1 to 0.5 parts of an oil soluble heterocyclic metal deactivator such as the aromatic triazoles including benzotriazole and tolyltriazole and effective amounts of at least one mildew-inhibiting compound i.e. amounts ranging from about 0.1 to 3.0 and preferably from 0.1 to 1.0 part by weight of the composition.

More specifically, the lubricating oils include oils of lubricating viscosity. These oils include natural and synthetic lubricating oils and mixtures, thereof having various viscosities. Natural oils include the mineral lubricating oils such as the paraffinic and naphthenic oils or mixtures thereof.

SHELLFLEX®-210 is a useful commercial oil product obtained from Shell Canada Limited. Other synthetic lubricating oils include the hydrocarbon oils, alkylene oxide polymers such as the polymerization of ethylene oxide or propylene oxide, esters of monocarboxylic acids and polyols, and silicon oils including the siloxane and silicate oils. Another group of synthetic lubricating oils comprises the esters of dicarboxylic acids e.g. phthalic acid, succinic acid, alkyl succinic acids and alkenyl succinic acids with a variety of alcohols and glycols e.g. butyl alcohol, hexyl alcohol, dodecyl alcohol, ethylene glycol, propylene glycol. Specific examples of these oils include dibutyl adipate, dioctyl sebacate, dioctyl phthalate and the like.

A variety of organic solvents are known and can be used for purposes of this invention. The preferred solvents are substantially non-polar or oleophilic solvents. These preferred solvents include solvents comprising aromatic or aliphatic hydrocarbons. Aromatic solvents include benzene, toluene, xylenes, and fractions from the distillation of petroleum. Aliphatic hydrocarbon solvents include hexane, cyclohexane, heptanes, octanes, and similar straight and branched hydrocarbons and mixtures thereof, generally having 4-16 carbon atoms. Included are the aliphatic fractions from distillation of petroleum including mineral spirits and various mixtures of these solvents in any ratio. Commercial solvents (paraffinic hydrocarbons) are available from Exxon Mobil under the product name ISOPAR.

The preferred corrosion inhibitors are derived from the reaction of at least one sulfonic acid such as petroleum sulfonic acid and at least one carboxylic acid with a metal compound to form a complex. The preferred corrosion inhibitors are derived from the stoichiometric reaction of a metal compound such as an alkaline earth metal with a sulfonic acid e.g. petroleum sulfonic acid and a carboxylic acid preferably at least one or more of the fatty acids to form the metal complex. For example, the sulfonic acids can have the formula $R^1(SO_3H)_y$ or $(R^2)_xR(SO_3H)_y$. Wherein $R^1$ is an aliphatic or aliphatic-substituted cycloaliphatic hydrocarbon containing up to about 30 carbon atoms. When $R^1$ is aliphatic, $R^1$ contains 10 to 20 carbon atoms; when $R^1$ is an aliphatic-substituted cycloaliphatic radical, the aliphatic substituents contain at least 8 carbon atoms. Examples of $R^1$ are alkyl, alkenyl and alkoxy-alkyl radicals, and aliphatic-substituted cycloaliphatic radicals wherein the aliphatic substituents are alkyl, alkenyl, alkoxy, alkoxyalkyl, or carboxyalkyl. The cycloaliphatics can be derived from cycloalkane or cycloalkenes such as cyclopentane, cyclohexane, cyclohexene or cyclopentene. Specific examples of $R^1$ are laurylcyclohexyl, cetyloxyethyl, octadecenyl, and radicals derived from petroleum, saturated and unsaturated paraffin wax, and olefin polymers including polymerized monoolefins and diolefins containing from 2-6 carbon atoms per olefinic monomer.

$R^2$ is a hydrocarbon radical containing from 4-30 aliphatic carbon atoms, preferably aliphatic hydrocarbons such as alkyl or alkenyl. $R^2$ can have substituents or interrupting groups as those set-forth above, provided the hydrocarbon character is retained. The radical R can be a cyclic group derived from an aromatic hydrocarbon including benzene, naphthalene, biphenyls or a heterocyclic group. The subscripts x and y have a value of 1, and can have a value ranging from 1 to 3.

Specific examples of the sulfonic acids include mahogany sulfonic acids, petroleum sulfonic acids, polywax-substituted naphthalene sulfonic acids, cetylphenol sulfonic acid, aryl sulfonic acids, naphthalene sulfonic acids, paraffin wax sulfonic acids, hydroxy-substituted sulfonic acids, isobutylene sulfonic acid, petroleum naphthene sulfonic acids, cyclopentyl sulfonic acid, cyclohexyl sulfonic acid, polywax-substituted sulfonic acids, dodecylbenzene sulfonic acid, and the like. These sulfonic acids are well-known in the art, and for purposes of this invention, the equivalent weight of a sulfonic acid is the molecular weight divided by the number of sulfonic acid groups, e.g. a monosulfonic acid has an equivalent weight equal to the molecular weight of the acid.

The carboxylic acids used in preparing the metal complexes include aliphatic, cycloaliphatic and aromatic mono- and polycarboxylic acids such as naphthenic acids, alkenyl-substituted pentanoic acids or the alkyl-substituted aromatic carboxylic acids. The aliphatic acids generally contain at least 6 and preferably at least 10 carbon atoms. The cycloaliphatic and aliphatic carboxylic acids can be saturated or unsaturated. Specific examples of the carboxylic acids include 2-ethylhexanoic acid, linolenic acid, substituted maleic acids, behenic acid, isostearic acid, pelargonic acid, capric acid, linoleic acid, lauric acid, oleic acid, ricinoleic acid, undecylic acid, myriatic acid, palmitic acid, acids formed by oxidation of petrolatum and mixtures of two or more carboxylic acids. The preferred carboxy acids include the fatty acids having the formulas $C_nH_{2n+1}$ COOH, $C_nH_{2n-1}$COOH or $C_nH_{2n-3}$ COOH. The equivalent weight of these carboxylic acids is the molecular weight divided by the number of acid groups. Effective amounts of a hydrocarbon wax such as paraffin, petrolateum and olefin waxes can be added to the corrosion-inhibiting composition to improve the application of the mildew corrosion-inhibiting composition.

Preferably, the sulfonate-carboxylate metal complexes are derived from alkaline earth metals compound such as calcium, barium or magnesium compounds. These metal neutralizing compounds include the metal oxides, hydroxides, carbonates, bicarbonates and mixtures thereof. These corrosion-resistant metal complexes are derived from the reaction of these metal compounds with stoichiometric amounts of the sulfonic acids and the carboxylic acids to form the metal complex. Commercial sulfonate-carboxylate complexes are available from King Industries under the mark NA-SUL®. The oil soluble organophosphates e.g. alkyl phosphates are derived from phosphorous and phosphoric acids forming the phosphoric acid mono- and diesters including the metal, ammonium or amine salts of these acids. A preferred class of these alkylphosphates are provided by Octel Starreon LLC under the trade name RP-2.

Oil soluble antioxidants are added to the mildew and corrosion-resistant compositions in amounts ranging from about 0.1 to 2.0 and preferably from 0.5 to 1.0 parts by weight. The preferred antioxidants are selected from the group consisting of the diphenylamines and derivatives there, alkylated diphenylamines, e.g. the alkylated phenylated amines, or the phenylnapthylamines and the like. Commercial antioxidants are available from King Industries under the mark NA-LUBE®AO-130. Other known antioxidants include the oil soluble phenols, sulfurized phenols, sulfurized olefins, alkyl sulfides, disulfides, and particularly the carbamates, and the alkylated phenols including the arylalkyl phenols. Specific phenols include 2-t-butylphenol, 2-sec-butylphenol, 2-isopropylphenol, 2,6-diisopropylphenol, 2-t-octylphenol, 2-cyclopentylphenol, and mixtures thereof.

The water-displacing agents or compounds are added to the mildew and corrosion-resistant composition in amounts ranging from about 0.1 to 5.0 parts and preferably in amounts of 1.0 to 2.0 parts. These water-displacing agents include the glycols, alkoxyalcohols, aliphatic alcohols such as butanol, ethers, ether alcohols, alkylene glycols such as propylene or ethylene glycol, diethylene glycol, 2-butoxethanol, pentanediol, hexylene glycol, glycol ethers, alkylene glycol ethers and mixtures thereof Other water displacing agents include the amine salts of various fatty acids and the alkyl diphenylamines. In addition, 0.0 to 1.0 part and preferably 0.1 to 0.5 part of a metal deactivating compound may be added to the mildew and corrosion-inhibiting composition. These compounds include the heterocyclic compounds and in particular compounds such as benzotriazole, tolyltriazole, and mixtures thereof. Commercially available metal deactivators can be obtained from King Industries under the mark K-CORR®.

For purposes of this invention, the fungi (mold and mildew) are nonphotosynthetic microorganisms that grow by elongation of threads or hyphae with average diameters of 5 μm (J. E. Smith and D. R. Berry, "An Introduction to Biochemistry of Fungal Development", Academic Press, New York, (1974), p. 85). Hyphae form complexes, branched masses called mycelia. Each hyphae contains a mass of cytoplasm and many nuclei. Aerial hyphae usually terminate in spore formations that may be either asexual or sexual. Each spore and each piece of filament produces a colony when exposed to solid nutrient media. Most fungi are aerobes and grow best in humid conditions with an optimum temperature for growth of 25° C. Pathogenic species have an optimal temperature of 37° C. Fungal spores can survive long periods of desiccation and starvation. An inactive fungal population may produce many thousands of spores after inoculation into a nutrient medium.

The CPC's of this invention can be either water-displacing or non-water displacing and can vary in appearance, viscosity, cure time, and surface condition. The CPC's used for comparison with the compositions of this invention were ALOX 2028, CORBAN 35 and NAVGUARD 210. The mildew inhibitors used in combination with the CPC's of this invention comprise Omacide 100 (O-100), Omacide 40 (O-40) and Zinc Omadine (ZO). Omacide® fungicides (3-iodo-2-propynylbutyl carbamate) characterized by the formula $C_8H_{12}INO_2$ are broad spectrum in their use and application. Zinc Omadine® comprises a zinc complex of pyrithione or pyridinethione characterized by the formula $C_{10}H_8N_2O_2S_2Zn$. The Omacides® and Omadine® compositions are commercially available from Arch Chemical, Inc. of Norwalk, Conn. 06856.

The following Examples illustrate the oleaginous mildew and corrosion-resistant compositions of this invention.

(NAVGUARD 210A)

| | Parts by Weight |
|---|---|
| Mineral Oil | 40.00 |
| Sulfonic acid-carboxylic acid alkaline earth metal complex | 40.00 |
| Organic solvent (aliphatic hydrocarbons) | 20.00 |
| Rust preventive agent (alkyl ammonium phosphate) | 1.0 |
| Water-displacing compound (alkylene glycol) | 1.5 |
| Antioxidant (diphenylamine) | 1.0 |
| Fungicide comprising zinc pyrithione or zinc pyridinethione | 0.5 |

(NAVGUARD 210B)

| | Parts by Weight |
|---|---|
| Mineral Oils (paraffinic and naphthenic oils) | 22.50 |
| Non-polar organic solvent | 15.00 |

-continued (NAVGUARD 210B)

| | Parts by Weight |
|---|---|
| Corrosion Inhibitor (sulfonic acid-carboxylic acid calcium complex) | 22.50 |
| Antioxidant (alkyl diphenylamines) | 0.25 |
| Water-displacing compound (hexylene glycol) | 1.0 |
| Rust preventive agent (alkyl ammonium phosphate) | 0.50 |
| Metal deactivator (benzotriazole) | 0.10 |
| 3-Iodo-2-propynylbutyl carbamate | 0.50 |

| | Parts by Weight |
|---|---|
| Lubricating oils (naphthenic and paraffinic oils) | 35 to 45 |
| Organic solvents (petroleum distillates and aliphatic hydrocarbons) | 15 to 30 |
| Corrosion inhibitors (sulfonic acid-carboxylic acid metal complexes, and mixtures with alkyl ammonium phosphates) | 35 to 45 |
| Antioxidants (alkyldiphenylamines) | 0.5 to 1.0 |
| Water-displacing compounds (alkylene glycols) | 0.0 to 5.0 |
| Metal deactivator (heterocyclic compounds) | 0.0 to 1.0 |
| Organic mildew-inhibiting compounds comprise the family of carbamates and the mercaptopyridines | 0.1 to 3.0 |

Methods and Materials

Twenty-four 2-inch by 4-inch 2024 aluminum panels were treated with CPC's, ALOX 2028, CORBAN 35 and NAVGUARD 210 and blended with effective amounts of the following three mildew inhibitors: Omacide® 100 (0-100), Omacide® 40 (0-40), and Zinc Omadine® (ZO). Twelve additional panels were treated only with CPC's as a control and an additional twelve panels were treated only with hydraulic fluid. Each of the panels were dipped in the designated treatment using a dipping tube, then each panel was placed on a rack and air-dried for 24 hours in a fume hood. After 24 hours, the air-dried panels were placed on a clean flat surface.

A spore suspension was prepared from *Aureobasidium, Fusarium*, and *Hormoconis*, previously isolated from H-53 aircraft (B. D. Lavoie, B. Little, R. Ray, K. Hart and P. Wagner, "Proceedings NACE International Corrosion"/97, paper No. 218, Houston, Tex., (1997). Fungi were grown for two weeks on PDA. Conidia were harvested by flooding the culture plates with 10 ml of sterile distilled water and dislodging conidia by softly brushing the colonies with a glass rod. Aqueous conidial suspensions were filtered through sterile Miracloth to remove hyphae. Conidia were washed three times by centrifuging for 10 minutes at low speed discarding the supernatant, re-suspending the conidial pellet in distilled water, and vortexing to disperse the conidia. Conidial concentrations were determined with a hematocytometer and appropriate dilutions made. A count of the final dilution was made to verify the accuracy of the dilution. A 20-ml spore suspension of $10^6$ spores/ml each were prepared from each culture. The individual suspensions were mixed before spraying.

Each treated panel (CPC control, plus blended mildew inhibitors, and hydraulic fluid) was sprayed with 1 ml of a spore suspension ($10^6$ of *Aureobasidium, Fusarium*, and *Hormoconis*) using a spray atomizer according to ASTM G21-02. ASTM Standard G21-90 (ASTM 1990) describes a method for determining the effect of fungi on the properties of synthetic polymeric materials. The portion of the standard that addresses inoculation of a surface with a spore suspension was used in these experiments. Triplicate Petri dishes containing potato dextrose agar (PDA) were sprayed with the same spore suspension at the beginning, middle, and end of the spraying procedure to check for consistency of the spore suspension and spray atomizer. Aseptic microbiological techniques were used for all inoculations and transfers.

After spraying, triplicate panels of each treatment and the panel coated with hydraulic fluid were immediately placed in a glove bag along with a Petri dish of distilled water (to maintain high humidity) and a thermometer/hygrometer (to measure temperature and humidity). Each glove bag was sealed and placed on a cart in a warm, isolated room for monitoring. Periodically each glove bag was opened and the Petri dish replenished with distilled water. The relative humidity was maintained between 80-92% at a temperature between 80-85° F.

Panels were examined after 35, 68 and 100 days. After 68 days, one of the triplicate panels of each treatment was dipped in hydraulic fluid and all panels previously dipped only in hydraulic fluid were re-dipped. After 100 days, nine panels exhibiting growth were removed from the glove bags to isolate and identify the fungal growth on the panels (Table 1). Aseptic microbiological techniques were used for all transfers of the panels from the glove bags to individual containers and again from the panels to sterile PDA plates.

Results

Inoculated PDA plates exhibited growth within one day with mycelium over the surface. Experiments were stopped at 34 days due to desiccation of the agar, however spores and mycelium were present throughout the agar as shown in FIG. 1.

Six of the inoculated treated panels and seven of the panels treated only with hydraulic fluid, exhibited fungal growth (see Table 1 and FIGS. 2 through 5) when examined microscopically. After 68 days, additional panels exhibited fungal growth (see Table 1 and FIG. 6). No additional growth was observed after 68 days even after additional hydraulic fluid was applied to some of the coupons. The remainder of the panels exhibited no fungal growth. Visible *Hormoconis* were isolated from all coupons treated with Corban 35 after 100 days. Fungi on all other plates were not viable, i.e., could not be grown on PDA.

TABLE 1

Number of Coupons Positive for Fungal Growth

| | # of Coupons | 35 Days | 68 Days |
|---|---|---|---|
| Alox 2028 | 3* | 1 | |
| Corban 35 | 3 | 3 | |
| Navguard 210 | 3 | — | 1 |
| Alox 2028 + Omacide 40 | 3 | — | |
| Corban 35 + Omacide 40 | 3 | — | |
| Navguard 210 + Omacide 40 | 3 | — | 1 |
| Alox 2028 + Zinc Omadine | 3 | — | |
| Corban 35 + Zinc Omadine | 3* | 2 | |
| Navguard 210 + Zinc Omadine | 3* | — | 1 |
| Alox 2028 + Omacide 100 | 3 | — | |
| Corban 35_Omacide 100 | 3 | — | |
| Navguard 210 + Omacide 100 | 3 | — | |
| Hydraulic fluid | 12 | 7 | |

*nine coupons sent to Dr. Ken Curry to isolate and identify fungal growth

For coating automotive or aircraft frames and the like, a solid "hot melt" composition is particularly suitable. For mildew and corrosion-inhibiting purposes, the thickened composition of this invention may be applied to the metal surface by methods including brushing, spraying, dip-coating, flow-coating, roller-coating and the like. The viscosity of a thickened composition may be adjusted for the particular method of application by adding an inert organic solvent. The coated metal surface may be dried by exposure to air or baking. If the coating composition is of correct viscosity, the coating or film can be applied directly to the metal surface and the solvent and drying may not be necessary. The film thickness is not critical, however, a coating ranging up to about 5,000 mg. or more per square foot for coatings of aircraft frames or other structural members is sufficient to provide adequate protection.

While this invention has been described by a number of specific examples, it is obvious to one skilled in the art that there are other variations and modifications which can be made without departing from the spirit and scope of the invention as particularly set forth in the appended claims.

The invention claimed:

1. An oleaginous corrosion-inhibiting composition for coating metal surfaces, comprising, in parts by weight, from about, 20 to 60 parts of a lubricating oil of lubricating viscosity selected from the group consisting of mineral oils, synthetic oils and mixtures of mineral oils and synthetic oils, 20 to 60 parts of at least one corrosion-inhibitor selected from the group consisting of a sulfonic acid-carboxylic acid metal complex wherein said metal complex is derived from a stoichiometric reaction of a metal base and the acids, and a mixture of said sulfonic acid-carboxylic acid metal complex with an oil soluble alkyl phosphate wherein said sulfonic acid-carboxylic acid metal complex ranges from about 97 to 99.9% by weight of said mixture, from about, 0.1 to 2.0 parts of an oil soluble antioxidant, from about 0.1 to 5.0 parts of an organic water-displacing compound selected from the group consisting of alcohols, glycols, ethers, ether-alcohols, glycol-ethers and amines, from about 0.1 to 3.0 parts of an organic mildew-inhibiting compound, from about 10 to 40 parts of at least one aliphatic or aromatic organic solvent and mixtures of said solvents.

2. The corrosion-inhibiting composition of claim 1 wherein about 0.1 to 0.5 parts of a heterocyclic metal-deactivating agent is added to the composition.

3. The corrosion-inhibiting composition of claim 2 wherein the heterocyclic-deactivating agent is a triazole.

4. The corrosion-inhibiting composition of claim 3 wherein the deactivating agent is benzotriazole.

5. The corrosion-inhibiting composition of claim 1 wherein the lubricating oil is a paraffinic, naphthenic or a mixture thereof.

6. The corrosion-inhibiting composition of claim 1 wherein the lubricating oil is a mixture of synthetic oils and mineral oils.

7. The corrosion-inhibiting composition of claim 1 wherein the sulfonic acid in the sulfonic-carboxylic acid complex is a paraffin-wax sulfonic acid.

8. The corrosion-inhibiting composition of claim 1 wherein the sulfonic acid in the sulfonic acid-carboxylic acid metal complex is a polywax-substituted sulfonic acid.

9. The corrosion-inhibiting composition of claim 1 wherein the sulfonic acid-carboxylic acid metal complex is a calcium alkylarylsulfonate-carboxylate with petroleum oxidate.

10. The corrosion-inhibiting composition of claim 1 wherein the carboxylic acid in the sulfonic acid-carboxylic acid metal complex is an aliphatic, aromatic, cycloaliphatic or fatty acid.

11. The composition of claim 1 wherein the antioxidant is selected from the group consisting of an alkylated amine, phenols, sulfides, and carbamates.

12. The corrosion-inhibiting composition of claim 1 wherein the water displacing compound is a glycol.

13. The corrosion-inhibiting compositions of claim 11 wherein the antioxidant is an alkylated phenylamine.

14. The corrosion-inhibiting composition of claim 1 wherein the mildew-inhibiting compound is selected from the group consisting of pyrithiones pyridines and carbamates.

15. The corrosion-inhibiting composition of claim 14 wherein the mildew-inhibiting compound is a carbamate.

16. A process for inhibiting the corrosion of a metal surface which comprises coating the metal surface with an effective amount of an oleaginous corrosion-inhibiting composition comprising, in parts by weight, from about 20 to 60 parts of a lubricating oil of lubricating viscosity selected from the group consisting of mineral oils, synthetic oils and mixtures of mineral oils and synthetic oils, 20 to 60 parts of at least one corrosion-inhibitor selected from the group consisting of a sulfonic acid-carboxylic acid metal complex wherein said metal complex is derived from a stoichiometric reaction of a metal base and the acids, and a mixture of said sulfonic acid-carboxylic acid metal complex with an oil soluble alkyl phosphate wherein said sulfonic acid-carboxylic acid metal complex ranges from about 97 to 99.9% by weight of said mixture, from about, 0.1 to 2.0 parts of an oil soluble antioxidant, from about 0.1 to 5.0 parts of an organic water-displacing compound selected from the group consisting of alcohols, glycols, ethers, ether-alcohols, glycol ethers and amines, from about 0.1 to 3.0 parts of an organic mildew-inhibiting-compound and from about 10 to 40 parts of at least one aliphatic or aromatic organic solvent or a mixture of said solvents.

17. A process for inhibiting the corrosion of metal surfaces which comprises coating the metal surface with an effective amount of an oleaginous corrosion-inhibiting composition comprising, in parts by weight, from about 35 to 45 parts of a lubricating oil of lubricating viscosity selected from the group consisting of mineral oils, synthetic oils and mixtures of mineral oils and synthetic oils, 35 to 45 parts of at least one corrosion-inhibitor selected from the group consisting of a sulfonic acid-carboxylic acid metal complex wherein said metal complex is derived from a stoichiometric reaction of a metal base and the acids, and a mixture of said sulfonic acid-carboxylic acid metal complex with an oil soluble alkyl phosphate wherein said sulfonic acid-carboxylic acid metal complex ranges from about 97 to 99.9% by weight of said mixture, from about, 0.5 to 1.0 parts of an oil soluble antioxidant, from about 1.0 to 2.0 parts of an organic water-displacing compound selected from the group consisting of alcohols, glycols, ethers, glycol-ethers and amines, from about 0.1 to 3.0 parts of an organic mildew-inhibiting compound from about 10 to 40 parts of at least one aliphatic or aromatic organic solvent and mixtures of said solvents.

18. The process of claim 17 wherein about 0.1 to 0.5 parts of a heterocyclic metal-deactivating agent is added to the composition.

19. The process of claim 17 wherein the lubricating oil is a paraffinic, naphthenic or a mixtures of said oils.

20. The process of claim 17 wherein the antioxidant is an aryl amine.

21. The process of claim 17 wherein the sulfonic acid of the sulfonic acid-carboxylic acid metal complex is a polywax-substituted sulfonic acid.

22. The process of claim 17 wherein an effective amount of a hydrocarbon wax is added to the corrosion-inhibiting composition to improve the application of the corrosion-inhibiting composition.

23. The process of claim 17 wherein the sulfonic acid-carboxylic acid metal complex is a calcium alkylaryl-sulfonate-carboxylate with petroleum oxidate.

24. The process of claim 17 wherein the carboxylic acid in the sulfonic acid-carboxylic acid metal complex is aliphatic, aromatic, cycloaliphatic or fatty acid.

25. The process of claim 17 wherein the mildew-inhibiting compound is selected from the group consisting of carbamates, pyrithiones, and pyridines.

26. The process of claim 17 wherein the mildew-inhibiting compound is a zinc pyrithione.

27. The process of claim 17 wherein the metal in the sulfonic acid-carboxylic acid metal complex is selected from the group consisting of calcium, barium strontium, zinc, and magnesium.

* * * * *